US005494437A

United States Patent [19]

Kubota et al.

[11] Patent Number: 5,494,437

[45] Date of Patent: Feb. 27, 1996

[54] GAS BURNER

[75] Inventors: Norikazu Kubota, Oragun; Kimitake Mineda, Osaka, both of Japan

[73] Assignees: Sanyo Electric Co., Ltd., Moriguchi; Hodaka Co., Ltd., Osaka, both of Japan

[21] Appl. No.: 104,238

[22] Filed: Aug. 9, 1993

Related U.S. Application Data

[63] Continuation of Ser. No. 849,167, Mar. 10, 1992, abandoned.

[30] Foreign Application Priority Data

Mar. 11, 1991 [JP] Japan ..... 3-70665

[51] Int. Cl.[6] ..... F23D 14/58

[52] U.S. Cl. ..... 431/181; 431/10; 431/350

[58] Field of Search ..... 431/9, 10, 347, 431/350, 181, 354

[56] References Cited

U.S. PATENT DOCUMENTS

| | | | |
|---|---|---|---|
| 1,817,470 | 8/1931 | Adams | 431/10 X |
| 3,586,241 | 6/1971 | Virgil | 431/183 |
| 3,586,242 | 6/1971 | Woolard | 431/183 |
| 3,993,449 | 11/1976 | Childs | 431/9 X |
| 4,389,185 | 6/1983 | Alpkvist | 431/351 X |
| 4,544,350 | 10/1935 | Ware, III et al. | 431/285 |
| 4,842,509 | 6/1989 | Hasenack | 431/10 |
| 5,049,066 | 9/1991 | Kaiya et al. | 431/354 X |

FOREIGN PATENT DOCUMENTS

| | | | |
|---|---|---|---|
| 52-6123 | 1/1977 | Japan . | |
| 0087511 | 4/1988 | Japan | 431/10 |
| 2140122 | 11/1990 | Japan . | |

*Primary Examiner*—Carl D. Price
*Attorney, Agent, or Firm*—Darby & Darby

[57] ABSTRACT

A gas burner comprising a gas nozzle 4 having a flame stabilizing plate 7 and gas jet orifices 8 at its top; and a burner corn 5 provided with a flame stabilizing plate 6 having secondary air passages 10 for combustion and primary air passages 9 for combustion formed between the flame stabilizing plate 6 itself and the outer periphery of the gas nozzle 4: the gas burner being characterized in that the primary air passages 9 for combustion are disposed so that primary air may pass between the flame stabilizing plate 6 and the outer periphery of the gas nozzle and may be mixed with a fuel gas 3 jetted through the gas jet orifices 8; the stream course of the mixed gas is changed to the periphery of the flame stabilizing plate 7 by this plate 7; and a part of the mixed gas is mixed with divided secondary air.

10 Claims, 3 Drawing Sheets

GAS BURNER

This is a continuation of application Ser. No. 07/849,167, filed Mar. 10, 1992 now abandoned.

BACKGROUND OF THE INVENTION (i) Field of the Invention

The present invention relates to a low-NOx gas burner which can be used in an absorption type water cooler/heater, an absorption type refrigerator, a vapor boiler and a hot water boiler and in which the production of nitrogen oxides (hereinafter abbreviated to "NOx") can be inhibited.

(ii) Description of the Prior Art

In recent years, it has been considered that air pollution increases gradually due to NOx and the like in exhaust gases discharged from factories and offices, and measures for the control of the air pollution are strongly desired.

NOx produced by the combustion of fuels can be classified into thermal Nox formed by the reaction of nitrogen and oxygen contained in air for combustion in a high-temperature state and fuel NOx formed by the oxidation of various nitrogen compounds contained in the fuel during combustion. In most of the cases where a gaseous fuel is used, the thermal NOx is formed owing to the elevation of a combustion temperature. The more the thermal NOx is produced, the higher is the concentration of oxygen, the higher is the combustion temperature, and the longer is the residence time of the exhaust gas at a high temperature.

Therefore, in order to decrease the amount of the formed thermal NOx, it is necessary to lower the oxygen concentration and the combustion temperature, and to rapidly complete the combustion for the sake of the curtailment of the combustion time.

On the basis of the above factors, there have been heretofore taken various measures to inhibit the formation of the NOx. These include the alternation of operating conditions, the decrease of excessive air, the reduction of heat generation in a combustion chamber, the drop of the preheating temperature of air for combustion, and the development of a low-NOx burner in which its structure is improved to control the production of NOx. However, when the above-mentioned measures other than the employment of the low-NOx burner are employed, an NOx value (assuming that $O_2$ is 0%) in the exhaust gas is only lowered to about 100 ppm, which is still unsatisfactory.

The measure of employing the low-NOx burner can be applied to existing apparatus by a relatively simple reconstruction, and its NOx inhibition effect is large. For these reasons, the development of an effective low-NOx burner is desired.

However, the conventional NOx burner can decrease the NOx to some extent, but the employment of the conventional NOx burner lowers the combustion temperature, so that a combustion rate decreases and the flame stabilizing performance deteriorates, with the result that unstable combustion occurs. Furthermore, incomplete combustion occur due to the drop of the combustion temperature, so that carbon monoxide (CO) and soot are undesirably generated.

Japanese Utility Model Application Laid-open No. 2-140122 discloses one example of the conventional low-NOx gas burners. In this burner, fuel jet orifices and air orifices are arranged on the periphery of a nozzle so as to locally correspond to each other, and therefore when a combustion gas pressure is low (e.g., about 100 $mmH_2O$), air is mixed sufficiently with a fuel gas, so that the combustion temperature rises and the NOx concentration also undesirably increases.

In addition, according to data described in the same publication, an NOx value in the exhaust gas is from about 40 to 50 ppm, which should be further decreased.

The conventional low-NOx burner has the following drawbacks:

(1) When the conventional low-NOx burner is employed, the combustion temperature drops, and this fact leads to the decrease of the combustion rate, the deterioration of the flame stabilizing performance and the occurrence of the unstable combustion.

(2) Additionally, the combustion temperature drops, and this fact leads to the incomplete combustion and the generation of carbon monoxide (CO) and soot.

(3) When the fuel gas pressure is low (e.g., about 100 $mmH_2O$), air is mixed sufficiently with the fuel gas, so that the combustion temperature rises and the NOx concentration also increases.

(4) The NOx value in the exhaust gas is from about 40 to 50 ppm, which is still at a high level.

SUMMARY OF THE INVENTION

In view of the above-mentioned situations, research has been conducted, and as a result, the following matters have been found:

As means for lowering a combustion temperature and reducing the production of NOx, (1) a weak/strong combustion is carried out, (2) a flame dividing system is used, and (3) an exhaust gas self-recycling system is utilized.

Additionally, in order to improve a flame stabilizing performance and to thereby assure the stability of the combustion, (1) the exhaust gas self-recycling system is utilized, and (2) a constitution to accelerate the mixing of a fuel gas with air is employed. The employment of a low-NOx burner having such a construction permits preventing the decrease of the combustion rate, the deterioration of the flame stabilizing performance and the occurrence of unstable combustion, even if the combustion temperature drops. In addition, irrespective of the drop of the combustion temperature, the low-NOx burner having the above-mentioned construction also prevents incomplete combustion, whereby the generation of carbon monoxide (CO) and soot can be inhibited. Moreover, even when a fuel gas pressure is low, the NOx concentration does not increase, and the NOx value in the exhaust gas can be controlled to a low level of about 30 to 40 ppm. As a consequence, the present invention has been now attained on the basis of the above-mentioned knowledge.

The above-mentioned weak/strong combustion means a combustion system in which the combustion is carried out by dividing a combustion region into a high fuel gas concentration region (e.g., an air ratio is from 0.4 to 0.6) and a low fuel gas concentration region (e.g., an air ratio is from 1.6 to 1.8) in order to lower the combustion temperature. Incidentally, the combustion temperature is highest at the combustion with an air ratio of 0.9 to 1.1.

The above-mentioned flame dividing system means that the combustion is carried out by dividing the flame, and the division of the flame increases heat dissipation from the flame to lower a flame temperature.

According to the above-mentioned exhaust gas self-recycling system, the exhaust gas recycles itself, whereby the combustion temperature decreases and the heat which the combustion gas (the exhaust gas) has is recycled to improve the flame stabilizing performance, thereby effectively preventing the occurrence of the unstable combustion.

The employment of the above-mentioned construction which can accelerate the mixing of the fuel gas with air can improve the flame stabilizing performance to effectively prevent the occurrence of the unstable combustion.

The invention, as seen in FIGS. 1 and 2 of the drawings, is directed to a gas burner comprising a gas nozzle 4 having a flame stabilizing plate 7 at its top and a plurality of gas jet orifices 8 at its top and on its periphery. The burner shell 5 is provided with a flame stabilizing plate 6 having a plurality of secondary air passages 10 for combustion separately formed on its periphery and a primary air passage 9 (FIG. 1A) or passages 9 (FIG. 2) for combustion formed between the flame stabilizing plate 6 itself and the outer periphery of the gas nozzle 4.

The gas burner also has the flame stabilizing plate 6 is disposed close to the flame stabilizing plate 7 so that the gas jet orifices 8 may be located between these plates 6 and 7. Primary air passages 9 for combustion,are disposed so that primary air streaming along the outer periphery of the gas nozzle 4 may pass between the flame stabilizing plate 6 and the outer periphery of the gas nozzle and may be mixed with a fuel gas 3 jetted through the gas jet orifices 8. The stream course of the mixed gas comprising the primary air and the fuel gas 3 is changed to the periphery of the flame stabilizing plate 7 by this plate 7. Also mixed gas streams between the flame stabilizing plates 6 and 7 and a part of the mixed gas is mixed with secondary air coming through the secondary air passages 10 for combustion.

The gas burner described preferably has a ratio of the sectional area of the primary air passages 9 to the total sectional area of the primary air passages 9 and the secondary air passages 10 is from 10 to 60%.

The above-mentioned ratio preferably is from 25 to 60%. When this ratio is less than 10%, the amount of the primary air decreases and the combustion rate lowers, so that the stable combustion cannot be carried out. Conversely when this ratio is more than 60%, the amount of the primary air increases and the weak/strong combustion cannot be effected, so that the divided flame and the exhaust gas self-recycling are also incomplete and the NOx reduction cannot be achieved any more.

The gas burner also can be constructed so that the positions of the gas jet orifices 8 and the secondary air passages 10 for combustion do not correspond to each other on the periphery of the gas nozzle.

The meaning of the requirement that the positions of the gas jet orifices 8 and the secondary air passages 10 for combustion do not correspond to each other around the gas nozzle is as follows: For example, in the case that the fuel gas nozzle 4 and the fuel gas jet orifices 8 are circular, if the fuel gas nozzle 4 is cut along the surface containing the fuel gas jet orifices 8, and if two tangent lines is drawn from the center of the fuel gas nozzle 4 to the fuel gas jet orifices 8, the above-mentioned meaning is that the secondary air passages 10 for combustion are not present in the range surrounded by the two tangent lines.

In the present invention, the positions of the gas jet orifices 8 and the secondary air passages 10 for combustion may correspond to each other around the gas nozzle. However, it is more preferable that these positions do not correspond mutually, because in such a construction, the control of the NOx formation can be more effectively achieved, depending upon selected conditions.

The gas burner nay also have the flame stabilizing plate 6 provided with cooling small holes through which a part of combustion air 2 passes.

Since the overheat of the flame stabilizing plate 6 can be prevented by this construction, a combustion temperature can be effectively lowered and the durability of the flame stabilizing plate 6 can be improved. No particular restriction is put on the shape, size, number and arrangement manner of the small cooling holes, but it is preferable to suitably decide on the number considering the construction of the gas nozzle and conditions for combustion.

.

Figure 3:
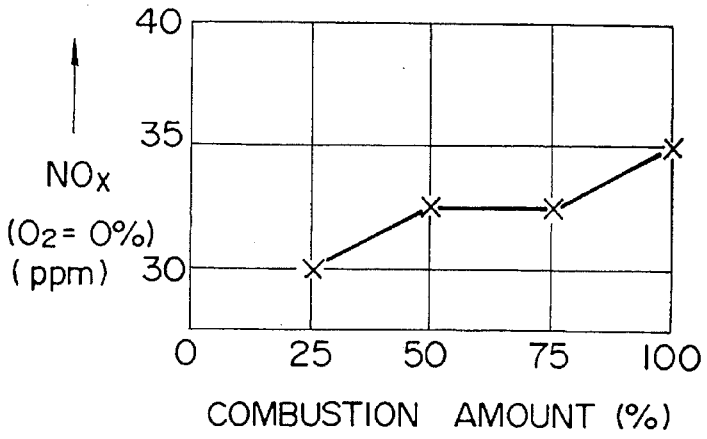

FIG. 3 shows the relation between a combustion amount and an NOx concentration in an exhaust gas.

Figure 4:
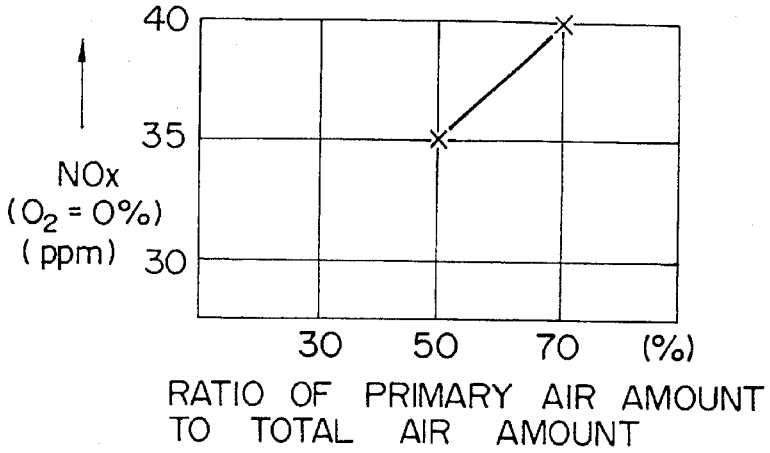

FIG. 4 shows the relation between the ratio of a primary air amount to the total air amount and the NOx concentration in the exhaust gas.

Figure 5:
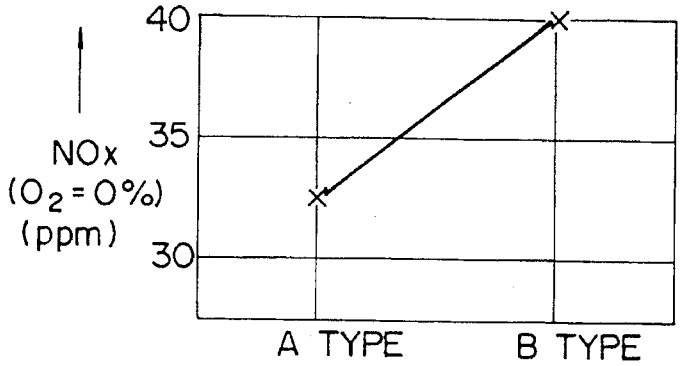

FIG. 5 shows the relation between the positional relation of gas jet orifices and secondary air passages for combustion and the NOx concentration in the exhaust gas.

DETAILED DESCRIPTION OF THE INVENTION

An embodiment of a low-NOx burner of the present invention will be described in detail in reference to FIGS. 1 and 2, but the scope of the present invention should not be limited to the embodiment, so long as it does not deviate from the gist of the present invention.

Figure 1:
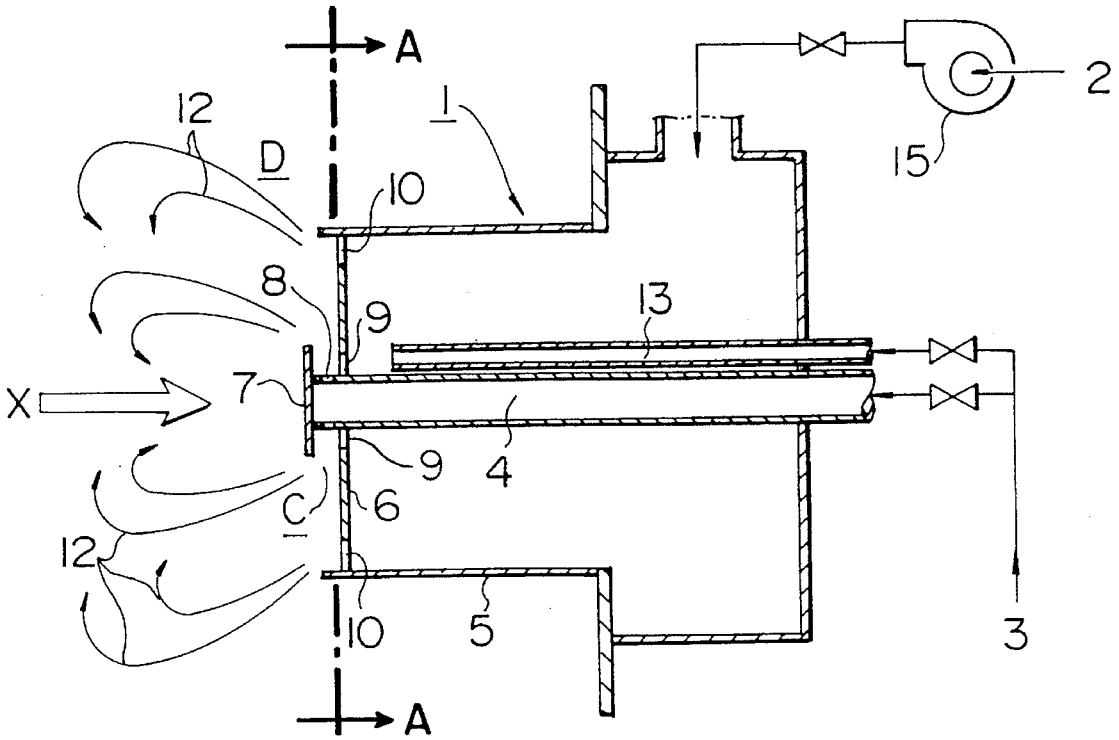
FIG. 1 shows a sectional view of a gas burner of the present invention.
Figure 2:
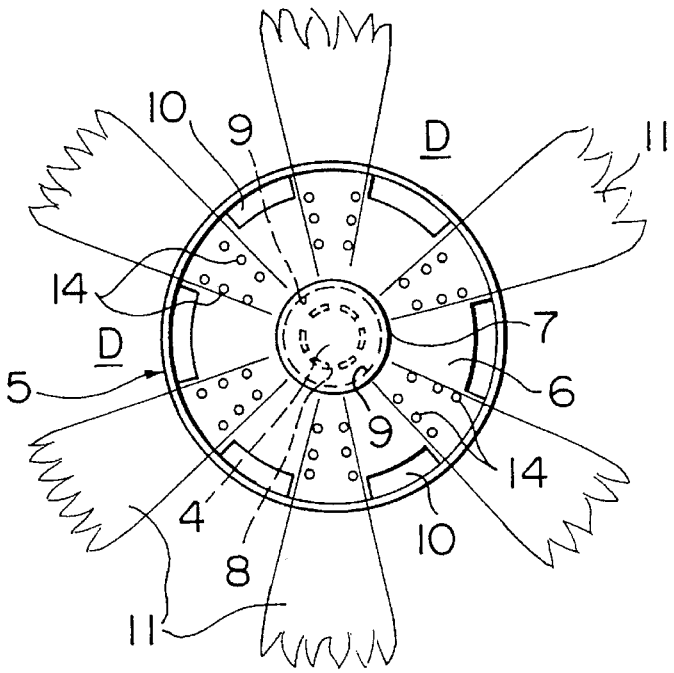
FIG. 2 shows a side view of the gas burner of the present invention as the gas burner is seen from of arrow X FIG. 1

FIG. 1 shows the sectional view of the low-NOx burner of the present invention, and FIG. 2 shows the side view as the low-NOx burner of the present invention is seen from the direction of an arrow X.

Figure 1A:
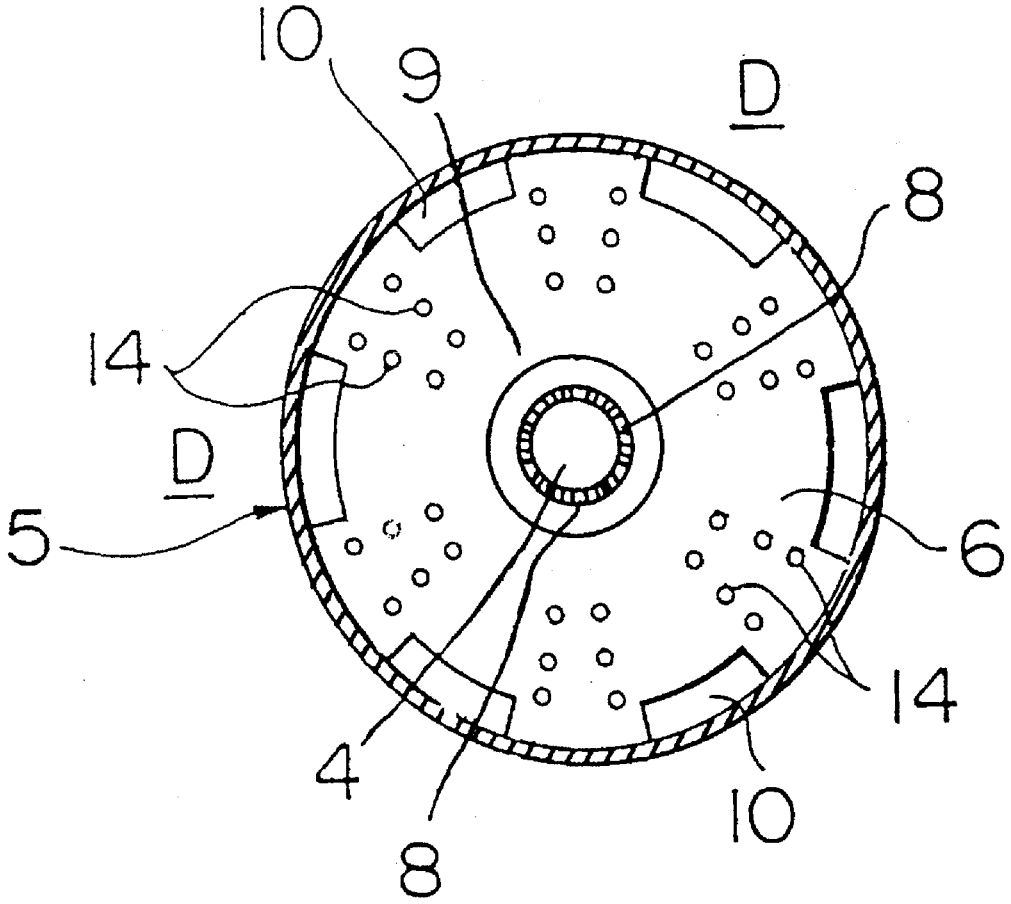
FIG. 1A is a front view of the burner taken along lines A—A of FIG. 1.

A gas burner 1 for mixing a fuel gas 3 with combustion air 2 coming through a fan 15 and performing combustion has a gas nozzle 4 having a flame stabilizing plate 7 at the top thereof and a plurality of gas jet orifices 8 on its periphery. The burner shell or housing has a flame stabilizing plate 6 and a pilot burner 13. The above-mentioned flame stabilizing plate 6 has a plurality of secondary air passages 10 separately formed along its periphery and a primary air passage 9 (FIG. 1A) or passages 9 (FIG. 2) for combustion formed between the flame stabilizing plate 6 itself and the outer periphery of the gas nozzle 4. Moreover, this flame stabilizing plate 6 is disposed close to the flame stabilizing plate 7 and is provided with cooling small holes 14.

The combustion of the fuel gas 3 by the use of the low-NOx burner of the present invention can be stably carried out as follows:

(1) The primary air coming through the primary air passages 9 is mixed with the fuel gas 3 to form the mixed gas, shown at C, having a high concentration.

(2) The secondary air is jetted through the secondary air passages 10 on the periphery of the flame stabilizing plate 6, and then mixed with a diffused part of the mixed gas C to form a mixed gas shown at D having a low concentration.

(3) The mixed gas C having the high concentration and the mixed gas D having the low concentration are used to perform weak/strong combustion.

(4) The secondary air passages 10 are separately disposed, and therefore a flame 11 obtained by the combustion of the mixed gas C having the high concentration is a divided flame. In the case of the low-NOx burner 1 shown in FIG. 1, the six gas jet orifices 8 having a diameter of 6 mm are provided. The six secondary air passages 10 for combustion which do not correspond locally to the gas jet orifices 8 around the gas nozzle are provided, and therefore the flame 11 is divided into six portions, as shown in FIG. 2.

(5) The flame stabilizing plate 6 is disposed close to the flame stabilizing plate 7, and therefore an exhaust gas self-recycling 12 is effected over a wide range.

(6) When the amount of the primary air is 10% or more, preferably 30% or more of the total amount of air, the recycling of the exhaust gas is accelerated in the range of the exhaust gas self-recycling 12 which is formed on the downstream side of the stabilizing flame plate 7.

(7) The mixed gas C is jetted in the vicinity of the flame stabilizing plate 6, and therefore the flame stabilizing performance is improved by the stabilizing flame plate 6.

A combustion test of the fuel gas 3 was carried out by the use of the low NOx burner 1 shown in FIG. 1 (fuel gas flow rate 30 $m^3$/hr., gas pressure 100 $mmH_2O$).

The NOx concentrations in the exhaust gas were measured by changing the exhaust gas combustion amount in the range of 25–100% of the rated capacity, and the measured values are shown in FIG. 3. The measured NOx concentrations were low, from 30 to 35 ppm, assuming that $O_2$ was 0%.

The NOx concentrations in the exhaust gas were measured by changing the ratio of the primary air amount to the total air amount in the range of 30–70%, and the measured values are shown in FIG. 4. The measured NOx concentrations were low, from 35 to 40 ppm, assuming that $O_2$ was 0%.

In the case that the gas jet orifices 8 were disposed so as to correspond locally, i.e., be in line with the secondary air passages 10 for combustion on the periphery of the gas nozzle 4 (type B) and in the case that these orifices 8 were disposed so as not to correspond thereto (type A), NOx concentrations were measured, and the results are shown by FIG. 5.

In the case of the type B, the NOx value was 50 ppm (assuming that $O_2$ was 0%), but in the case of the type A, the NOx value was low, 35 ppm.

When the low NOx burner of the present invention is used, the following effects can be obtained:

(1) The weak/strong combustion and the divided flame system has good balance and hence they function effectively, so that the stable combustion can be accomplished.

(2) The large exhaust gas self-recycling range is formed, and therefore the control effect of the NOx formation is large and the stable combustion can be achieved.

(3) Any unstable combustion is not present. Also, CO is not generated owing to no incomplete combustion, so that the stable combustion can be achieved. The NOx concentration in the exhaust gas is from 30 to 35 ppm, assuming that $O_2$ is 0%, and this concentration is about 30% lower than a value (40 to 50 ppm) in the case of a conventional low NOx burner.

As described above, the present invention intends to provide a low-NOx burner by which the formation of NOx is controlled, and according to the construction of the low-NOx burner regarding the present invention, a weak/strong combustion system, a divided flame system and an exhaust gas self-recycling system can be carried out, and the mixing of a fuel gas and air can be accelerated. Therefore, even if the combustion temperature decreases, a combustion rate and a stabilizing flame performance can be maintained to prevent unstable combustion from occurring. Furthermore, even when the combustion temperature lowers, no incomplete combustion takes place, so that carbon monoxide (CO) and soot are not formed. In addition, even when the fuel gas pressure is low, an NOx concentration does not increase, and an NOx value in the exhaust gas can be controlled to a low level of about 30 to 40 ppm.

As discussed above, the gas burner of the present invention can be suitably used in an absorption type water cooler/heater, an absorption type refrigerator, a vapor boiler and a hot water boiler.

What is claimed is:

1. A gas burner comprising:

a shell, a planar first flame stabilizing plate located inwardly of one end of said shell, said first flame stabilizing plate having a plurality of secondary air passages spaced at equal distances around its periphery to admit secondary air into said shell in a direction generally transverse to said first flame stabilizing plate and axially of said shell, a fuel nozzle tube in said shell extending axially thereof and having an end of smaller area than that of said first flame stabilizing plate and extending through said first flame stabilizing plate, said first flame stabilizing plate also having a plurality of primary air passages provided concentrically around and adjacent to said nozzle tube where it extends through said first flame stabilizing plate, means for injecting air into said shell to exit through said primary and secondary air passages of said first flame stabilizing plate, a second flame stabilizing plate of smaller size than said first stabilizing plate located at the extending end of said nozzle tube, said second flame stabilizing plate opposing and overlying said plurality of primary air passage of said first flame stabilizing plate, the extending end of said nozzle tube having a plurality of orifices for discharging combustible fuel in the space between said second flame stabilizing plate and said first flame stabilizing plate in a direction toward the periphery of said first flame stabilizing plate, and the combustible fuel exiting from each of said orifices mixing with the air from at least one primary air passage and a portion of the fuel-air mixture flowing into the space between said first and second flame stabilizing plates and outwardly toward the periphery of said first flame stabilizing plate, another portion of the fuel-air mixture also flowing toward the second flame stabilizing plate and outwardly to said space between the second flame stabilizing plate and said secondary air passages of said first flame stabilizing plate to mix with the air exiting from said secondary air passages to produce divided flames for the fuel exiting from said orifices.

2. The gas burner according to claim 1 wherein the ratio of the cross-sectional area of the primary air passages to the secondary air passages is from 10 to 60%.

3. The gas burner according to claim 1 wherein there are a plurality of gas jet orifices on the extending end of said nozzle, the positions of the gas jet orifices and the secondary air passages being angularly offset from each other.

4. The gas burner according to claim 2 wherein the first flame stabilizing plate is provided with cooling holes located between said primary and said secondary air passages through which a part of combustion air passes.

5. The gas burner according to claim 1 wherein there are a plurality of gas jet orifices equal in number to the plurality of secondary air passages at the extending end of said nozzle, the positions of the gas jet orifices and the secondary air passages being angularly offset from each other with radially extended lines from the ends of each said gas orifice defining the spring between the secondary air passages.

6. The gas burner according to claim 5 wherein the first flame stabilizing plate is provided with cooling holes located between said primary and said secondary air passages through which a part of combustion air passes.

7. The gas burner according to claim 1 wherein the first flame stabilizing plate is provided with cooling holes located between said primary and said secondary air passages through which a part of combustion air passes.

8. A gas burner comprising:

a shell, a planar first flame stabilizing plate located inwardly of one end of said shell, said first flame stabilizing plate having a plurality of secondary air passages spaced at equal distances around its periphery to admit secondary air into said shell, a fuel nozzle tube in said shell having an end of smaller area than that of said first flame stabilizing plate and extending through said first flame stabilizing plate, said first flame stabilizing plate also having at least one primary air passage provided around and adjacent to said nozzle tube where it extends through said first flame stabilizing plate, means for injecting air into said shell to exit through said primary and secondary air passages of said first flame stabilizing plate, a second flame stabilizing plate of smaller size than said first stabilizing plate located at the extending end of said nozzle tube, said second flame stabilizing plate opposing and overlying said at least one primary air passage of said first flame stabilizing plate, the extending end of said nozzle tube having a plurality of gas jet orifices equal in number to the plurality of secondary air passages at the extending end of said nozzle, the positions of the gas jet orifices and the secondary air passages being angularly offset from each other with radially extended lines from the ends of each said gas orifice defining the spacing between the secondary air passages, the combustible fuel exiting from each of said orifices mixing with the air from at least one primary air passage and a portion of the fuel-air mixture flowing into the space between said first and second flame stabilizing plates and outwardly toward the periphery of said first flame stabilizing plate, another portion of the fuel-air mixture also flowing toward the second flame stabilizing plate and outwardly to said space between the second flame stabilizing plate and said secondary air passages of said first flame stabilizing plate to mix with the air exiting from said secondary air passages to produce divided flames for the fuel exiting from said orifices.

9. The gas burner according to claim 8 wherein the first flame stabilizing plate is provided with cooling holes located between said primary and said secondary air passages through which a part of combustion air passes.

10. A gas burner comprising:

a shell, a planar first flame stabilizing plate located inwardly of one end of said shell, said first flame stabilizing plate having a plurality of secondary air passages spaced at equal distances around its periphery to admit secondary air into said shell, a fuel nozzle tube in said shell having an end of smaller area than that of said first flame stabilizing plate and extending through said first flame stabilizing plate, said first flame stabilizing plate also having a plurality of primary air passages provided around and adjacent to said nozzle tube where it extends through said first flame stabilizing plate, means for injecting air into said shell to exit through said primary and secondary air passages of said first flame stabilizing plate, a second flame stabilizing plate of smaller size than said first stabilizing plate located at the extending end of said nozzle tube, said second flame stabilizing plate opposing and overlying said plurality of primary air passages of said first flame stabilizing plate, the extending end of said nozzle tube having at least one orifice for discharging combustible fuel in the space between said second flame stabilizing plate and said first flame stabilizing plate in a direction toward the periphery of said first flame stabilizing plate, and the combustible fuel exiting from said at least one orifice mixing with the air from at least one primary air passage and a portion of the fuel-air mixture flowing into the space between said first and second flame stabilizing plates and outwardly toward the periphery of said first flame stabilizing plate, another portion of the fuel-air mixture also flowing toward the second flame stabilizing plate and outwardly to said space between the second flame stabilizing plate and said secondary air passages of said first flame stabilizing plate to mix with the air exiting from said secondary air passages to produce divided flames for the fuel exiting from said at least one orifice, and wherein the ratio of the cross-sectional area of the primary air passages to the secondary air passages is from 10 to 60%.

* * * * *